US008672170B2

(12) United States Patent
Kanervo

(10) Patent No.: US 8,672,170 B2
(45) Date of Patent: Mar. 18, 2014

(54) DEEP REFUSE CONTAINER

(75) Inventor: Janne Kanervo, Helsinki (FI)

(73) Assignee: Janne Kanervo, Helsinki (FI)

( * ) Notice: Subject to any disclaimer, the term of this patent is extended or adjusted under 35 U.S.C. 154(b) by 0 days.

(21) Appl. No.: 13/183,897

(22) Filed: Jul. 15, 2011

(65) Prior Publication Data

US 2013/0015189 A1 Jan. 17, 2013

(51) Int. Cl.
*B65D 88/76* (2006.01)

(52) U.S. Cl.
USPC ..... 220/484; 220/906; 220/23.87

(58) Field of Classification Search
USPC ..... 220/484, 908, 23.87
See application file for complete search history.

(56) References Cited

U.S. PATENT DOCUMENTS 607,524 A * 7/1898 Reed ..... 220/484
1,115,016 A * 10/1914 Pheils ..... 220/484
2,558,322 A * 6/1951 Stine ..... 220/645
3,050,209 A * 8/1962 Germaine et al. ..... 220/484
4,005,791 A * 2/1977 Stragier et al. ..... 414/408
4,570,812 A * 2/1986 Curtis ..... 220/484
4,992,018 A * 2/1991 Prout et al. ..... 414/408
5,238,356 A * 8/1993 Salli ..... 414/403
2007/0068946 A1* 3/2007 Marshall ..... 220/484

* cited by examiner

*Primary Examiner* — J. Gregory Pickett
*Assistant Examiner* — Blaine Neway
(74) *Attorney, Agent, or Firm* — Young & Thompson

(57) ABSTRACT

A deep refuse container with a greater volume for garbage, container can be emptied by using automated elements. The deep refuse container includes a body part having at least one inner space for garbage, and a frame part including an open upper end, a lower end and at least one side for supporting the body part. The frame part of the deep refuse container of is disposed below the ground level so that the upper end of the frame part is substantially at the same level with the ground level or above the ground level. The body part of the deep refuse container is disposed into the frame part so that a lower portion of the body part locates inside the frame part and upper portion of the body part locates above the frame part. The body part is further provided with one or more contact parts for automated emptying elements.

15 Claims, 1 Drawing Sheet

DEEP REFUSE CONTAINER

TECHNICAL FIELD

Figure 1:
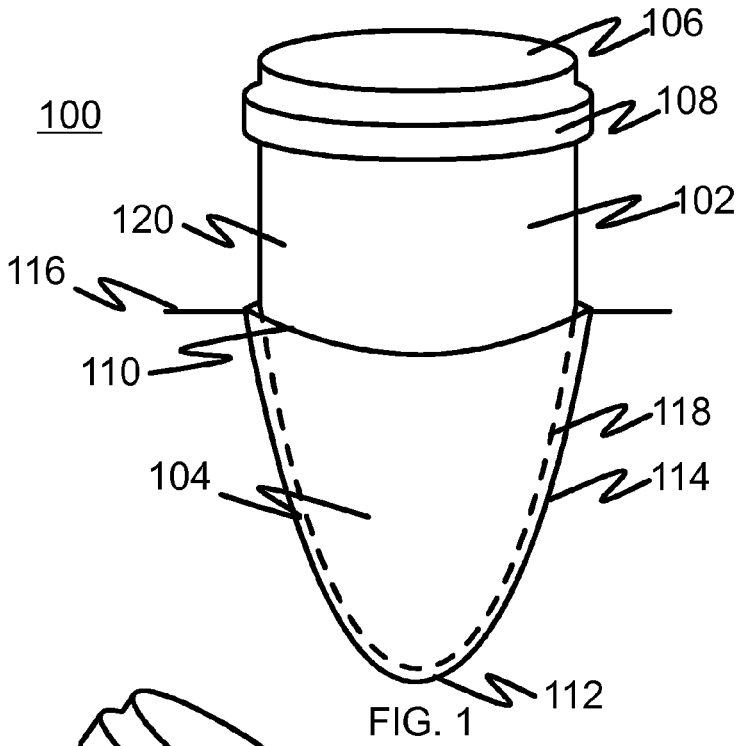

Generally, the invention relates to a refuse container. More specifically, the invention relates to a deep refuse container.

BACKGROUND TECHNOLOGY

Waste management, such as collecting, transporting, processing and recycling, is one of the basic requirements in today's society. In addition, domestic households have been taught to sort their garbage e.g. organic, paper, metal and glass waste from the other waste, which has increased the number of refuse containers per domestic household or collecting unit.

In US, Australia and Canada, for example, a curbside collection (or kerbside collection) is a system typically used in urban and suburban areas for waste collection from domestic households. Waste materials are usually collected in large bins, which are disposed in a curbside nearby a house or collecting unit they are related to. Generally, differently colored refuse containers are assigned to different type of waste.

Emptying of refuse containers are normally provided by local government authorities or, when outsourced, private companies. Typically, each waste type is collected separately or, at least, in its own section, if a garbage collecting vehicle has ability to collect different waste type into separate compartments. Nevertheless, because of the required emptying frequency and the number of the refuse containers to be emptied, refuse collecting is time-consuming and thus expensive process.

The prior art knows solutions, such as side loader garbage collection vehicles, which have an automated sidearm for seizing the refuse container and tipping it above a garbage compartment of the vehicle. In this way, it is possible to save time, since the driver does not need to come out from the vehicle to transfer the refuse container to be emptied, and the solution offers to personnel a lighter way to perform the emptying process. Even though the process is lighter than the former way, frequent emptying cycles are still required, which, in turn, requires great number of garbage collecting vehicles and, thus personnel to handling the process.

SUMMARY OF THE INVENTION

The purpose of the present invention is to avoid or reduce the above disadvantages of the prior art.

The object of the invention is achieved with a deep refuse container providing greater volume for garbage, which container can be emptied by using automated means.

A deep refuse container according to the present invention is characterized by the features of claim 1.

Some preferable embodiments of the invention are described in the dependent claims.

According to a preferable embodiment, a deep refuse container comprises a body part having at least one inner space for garbage, and a frame part comprising an open upper end, a lower end and at least one side for supporting said body part. The frame part of the deep refuse container of the present invention is disposed below the ground level so that said upper end of said frame part is substantially at the same level with the ground level or above the ground level. The body part of the deep refuse container is disposed into said frame part so that a lower portion of said body part locates inside the frame part and upper portion of said body part locates above the frame part. The body part is further provided with one or more contact parts for automated emptying means.

In one embodiment of the present invention a portion of said inner space locates below the ground level.

In one embodiment of the present invention the lower portion of said body part is cone-shaped. In another embodiment of the present invention both the lower portion of the body part and the lower end of the frame part are cone-shaped.

In one embodiment of the present invention the frame part is fixedly connected to the ground.

In one embodiment of the present invention the contact part is a protrusion part, such as a collar around the body part and/or a shoulder/shoulders in one side or in both sides of the body part. In another embodiment, the contact part is a depression part around the body part or in one side or in both sides of the body part. Yet, in one embodiment the contact part is formed in said body part. In another embodiment the contact part is a separate part and fixedly attached to said body part.

Yet, in one embodiment the body part further comprises a lid, which lid, in one embodiment, is hinged and may further comprise a gravitational lock.

Significant advantages can be achieved with the present invention when compared to the prior art solutions. The deep refuse container according to the present invention may comprise larger volume for garbage, which, in turn, may decrease the required emptying frequency of the refuse containers. One deep refuse container according to the present invention may also comprise more than one inner space for garbage, which may enable several waste types to be collected in the same container. Naturally, this feature may save time and space, if one large container could be used for various waste types.

In addition, the deep refuse container according to the present invention may be emptied by using an automated emptying means, such as garbage collecting vehicle with automated sidearm. This may enable the present invention to be utilized in areas, where a curbside collection system is used. Naturally, these advantages of the present invention may bring savings in time, material and space, when less refuse containers, garbage collecting vehicles and, therefore, fewer personnel may be needed.

Finally, the cone-shaped form of the present invention may facilitate stacking and transporting of the frame part and/or body part, which may save space when storing and transporting body parts and/or frame parts.

SHORT DESCRIPTION OF THE DRAWINGS

Figure 2:
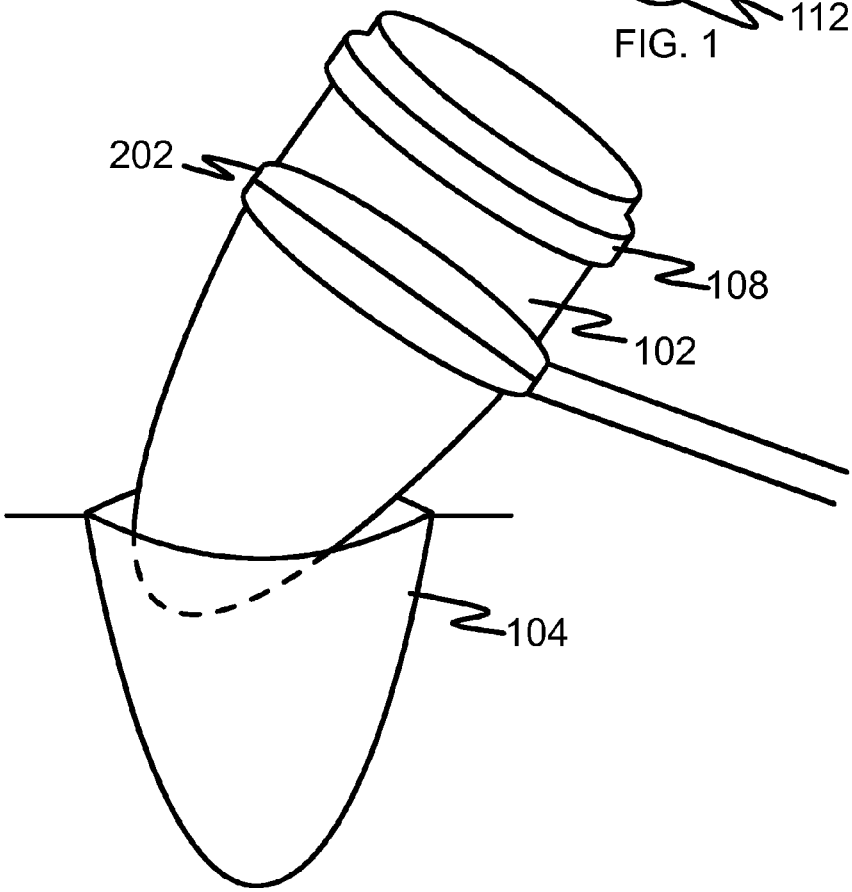

Next, the invention is described in more detail with reference to the appended drawings, in which FIG. 1 illustrates a side view of a deep refuse container in use according to an embodiment of the present invention, FIG. 2 illustrates a side view of a deep refuse container when emptied according to an embodiment of the present invention.

DETAILED DESCRIPTION OF THE EMBODIMENTS

FIG. 1 illustrates a side view of a deep refuse container in use according to an embodiment of the present invention. The deep refuse container 100 of the present invention comprises a body part 102 and a frame part 104. The body part 102 comprises at least one inner space 106 for garbage and at least one contact part 108 for automated emptying means. The frame part 104 comprises an open upper end 110, a lower end 112 and at least one side 114 for supporting the body part 102.

When in use, the frame part 104 is disposed below the ground level 116 so that the upper end 110 of the frame part 104 is substantially at the same level with the ground level 116 or above the ground level 116. The body part 102 is disposed into the frame part 104 so that a lower portion 118 of the body part 102 locates inside the frame part 104 and an upper portion 120 of the body part 102 locates above the frame part 104.

The frame part 104 of the present invention can be made of any suitable material for a typical supporting member, such as, but not limited to, plastics, fiberglass, concrete, various metals, e.g. steel or aluminum, or a combination of one or more materials, e.g. outer layer from concrete and inner layer from plastic or some other combination. Additionally, the frame part can also comprise mesh reinforcement part, which can be a layer in the frame part, embedded in the frame part, or which mesh reinforcement part can form a portion or the whole the frame part.

Preferably, the form of the frame part 104 is an upside down cone, so that the lower end 112 is the top of the cone. The top of the cone is preferably round or roundish allowing more space to locate below the ground level, but it can also be sharp. Typically, in top view the frame part is round-shaped, but in another embodiment, the frame part 104 has some other shape, such as square, for example. However, also in these embodiments, the frame part can taper to the lower end. Yet in another embodiment the frame part can be as rectangular cuboid-shaped or cubic-shaped.

The height of said frame part is preferably e.g. about 0.3 m-1.5 m, more preferably e.g. about 0.4 m-1.25 m and most preferably e.g. about 0.5 m-1 m from bottom of said frame part to the ground level.

Normally, the frame part 104 is fixedly connected to the ground. The frame part may have been casted in the ground and/or the frame part may have some anchoring means for connecting it to the ground (not shown).

As described above, the frame part 104 is disposed below the ground level 116, so that the upper end 110 of the frame part 104 is substantially at the same level with the ground level 116 or above the ground level 116. In embodiments, where the frame part 104 is installed to the ground, so that upper end 110 is above the ground level, the height of the upper end above the ground level is preferably e.g. about 0.005 m-0.1 m, more preferably e.g. about 0.01 m-0.07 m, most preferably e.g. about 0.02 m-0.05 m.

The body part 102 of the present invention can be made of any suitable material for a typical refuse container, such as, but not limited to, fiberglass, plastics, metals, e.g. as steel, aluminum, or a combination of various, suitable materials, so that the upper portion 120 of the body part can be different material than the lower portion 118, for example.

In top view, the upper portion 120 is preferably round-shaped, but it is obvious to those skilled in the art that the shape of the upper portion can be something else, such as square. The form of the upper portion 120 of the body part is preferably tubular, but it can also be rectangular cuboid or cube, for example.

The height of the upper portion of body part is preferably e.g. about 0.4 m-1.6 m, more preferably e.g. about 0.6 m-1.4 m, most preferably e.g. about 0.8 m-1.2 m from the ground level.

Typically, top view of the shape of the lower portion's upper end 110 complies with the top view of the shape of the upper portion 120, but the lower portion is preferably tapered to the lower end of the body part, so that the emptying of the container by using automated means is possible to perform. The tapered lower portion 118 enable the body part to rotate to different angle, when using the automated means to lift the body part up in order to empty it. Lifting up the body part a little provides a gap between the frame part and the body part.

Preferably, the form of the lower portion 118 suits to the form of the frame part 104, so that the body part 102 sets firmly in the frame part 104, but it will be apparent to those skilled in the art that the part of the lower portion 118 or the whole lower portion 118 can have a different form than the frame part 104, if the body part 102 is arranged to be disposed to the frame part 104 firmly.

One or more inner spaces for garbage are provided inside the body part 102. In FIG. 1 it is presented an embodiment with one inner space 106. Preferably, the inner space 106 extends from the upper portion 120 to the lower portion 118 of the body part 102, so that the volume for garbage is as wide as possible. When extending to the lower portion 118, a portion of the inner space 106 preferably locates below the ground level. Normally, the form of the inner space 106 or an entity of the inner spaces of the body part 102 complies with the form of the body part 102, but it is obvious to those skilled in the art that the form of the inner space 106 or the entity of the inner spaces can be some other than the form of the body part 102.

The volume of the inner space can vary depending on the embodiment. Preferably the volume of the inner space or the entity of inner spaces is e.g. about 400 l-1200 l, more preferably e.g. about 600 l-1100 l and most preferably e.g. about 800 l-1000 l. If the body part comprises more than one inner space, the volumes can be equal, or the volumes can be divided according to the amount of the waste types.

The deep refuse container according to the present invention comprises one or more contact parts, which contact part is provided with the body part. The objective of the contact part is to provide to an automated emptying means a part or an area, from which the automated emptying means, such as an automated sidearm of a garbage collecting vehicle, can clamp the body part in order to lift and tip it. Another objective of the contact part is to provide a part or an area, which part or area can prevent the body part from slipping of a grip of the automated arm, when lifting and tipping the body part.

In one embodiment, the contact part is a protrusion. The protrusion can be formed as a collar 108, which collar 108 extends around the body part 102. The protrusion can also be formed as a shoulder in one side or shoulders in both sides of the body part. It will be apparent to those skilled in the art that the body part can comprise more than two shoulders. The protrusion can be provided in the upper end of the upper portion 120 of the body part 102 and/or in the lower end of the upper portion 120 of the body part 102. In another embodiment, the protrusion is provided substantially in the middle of the body part in vertical direction, so as to provide a part or an area to the automated arm to clamp over the contact part. Those skilled in the art will appreciate that the height substantially in the middle of the body part means the normal clamping height of the sidearm, if that height is defined. In addition, those skilled in the art appreciated that the contact part formed in upper end of the upper portion 120 of the body part 102 and/or in the lower end of the upper portion 120 of the body part 102 can also be used as a part or an area to the automated arm to clamp over.

In another embodiment, the contact part is a depression around said body part or in one side/both sides of said body part. Preferably, the depression is provided substantially in the middle of the body part in vertical direction, so as to provide a part or an area to the sidearm, where to clamp the body part. However, it is also possible to provide a depression in the upper end of the upper portion of the body part and/or in the lower end of the upper portion of the body part, if the clamping height of the automated arm is in that level.

It will be apparent to those skilled in the art that a body part can comprise a number of various types of contact parts in order to be suitable for different types of automated emptying means.

In one embodiment, the contact part of the present invention is formed in the body part. The contact part can be molded at the same time with the body part. In that case, the contact part is typically made of the same material as the body part. In another embodiment, the contact part is a separate part and fixedly attached to the body part. In that case, the contact part can be made of plastics, metals, such as steel, aluminum, or some other suitable material(s). The contact part can be attached to the body part by using some appropriate attaching means, such as, but not limited to, screw(s), nut(s) and bolt(s), rivet(s), gluing or some combination thereof.

The depth of the contact part, i.e. the distance between the surface of the body part and the surface of the contact part either upwards or downwards from the surface of the body part, may vary depending of the embodiment. Preferably, the depth is e.g. about 1 cm-10 cm, more preferably 2 cm-8 cm and most preferably 4 cm-6 cm.

The width of the contact area depends on embodiment and the automated emptying means the deep refuse container of the question is meant for. In embodiments, wherein the contact area prevents the body part slipping from the grip of the automated arm, the contact area can be quite narrow, such as e.g. 1 cm-3 cm, if the material of the contact area is sufficiently rigid and durable. On the other hand, in embodiments, wherein the automated emptying means is intended to clamp over the contact area, the width of the contact area is selected so that the automated arm can provide a firm grip from the body part.

Yet, in some embodiments the body part further comprises a lid or lids. If the body part comprises more than one inner space, each volume can have its own lid, or, in some other embodiments, share the same lid. The lid can be made of the same material as the body part, such as, but not limited to, plastics, aluminum or some other suitable material. The lid can cover the whole open upper end of the body part or just part of it. In one embodiment, the lid is hinged. Yet, in another embodiment, the lid further comprises a gravitational lock. In that case, the lid is typically arranged so that only part of lid is openable when the deep refuse container of the present invention is in use and, when tipping the container in order to empty it, the weight of the garbage in the inner space is able to push the whole lid open. This solution may decrease the risk of wrong material to end up in the container.

FIG. 2 illustrates a side view of a deep refuse container when emptied according to an embodiment of the present invention. An automated means, such as an automated arm 202 of a garbage collecting vehicle is provided to reach the body part of deep refuse container according to the present invention in an appropriate height range relative to the upper portion of the body part 102 of the deep refuse container. In the embodiment of the FIG. 2, the automated arm 202 is provided to grip the upper portion of the body part 102 under the contact part 108. After that, the automated arm 202 is provided to lift the body part 102 up an appropriate amount for detaching the body part 102 from the frame part 104. After lifting or while lifting the body part 102, the automated arm is provided to rotate the body part to different angle, preferably over 90 degrees in total in order to tip. If needed, the automated arm 202 is also provided to retract a certain distance. After emptying the inner space of the body part, the automated arm 202 is provided to return the body part 102 into the frame part 104 by rotating the body part 102 to its original angle and, if needed, rereaching the automated arm 202 the same distance it has been retracted. Normally, the change in the body part's angle returns the opened lid/lids back to its closed position.

The scope of the invention is determined by the attached claims together with the equivalents thereof. The skilled persons will again appreciate the fact that the explicitly disclosed embodiments were constructed for illustrative purposes only, and the scope will cover further embodiments, embodiment combinations and equivalents that better suit each particular use case of the invention.

The invention claimed is:

1. A deep refuse container for garbage, the deep refuse container comprising:

a removable body part comprising at least one inner space for garbage; and a frame part comprising an open upper end, a lower end and at least one side for supporting said body part, wherein said frame part is fixedly disposed below the ground level so that said upper end of said frame part is substantially at the same level with the ground level, said body part is disposed into said frame part so that a lower portion of said body part is positioned inside said frame part arranging a portion of the inner space of the body part below the ground level, and an upper portion of said body part is positioned above said frame part, the lower portion of the body part being cone-shaped, a shape of the lower end of the frame part corresponding to the cone-shaped lower portion of the body part to assist lifting and tipping movements of the body part, and the body part comprising one or more contact parts provided in a side of the body part to enable an automated emptying means to clamp the body part from the side of the body part to lift and tip the body part when emptying the deep refuse container.

2. The deep refuse container according to claim 1, wherein the height of said upper portion of said body part is about 0.8 m-1.2 m from the ground level.

3. The deep refuse container according to claim 1, wherein the height of said frame part is about 0.5 m-1 m from a bottom of said frame part to the ground level.

4. The deep refuse container according to claim 1, wherein the one or more contact parts comprise one or more of a protrusion around said body part and a shoulder in one or more sides of said body part.

5. The deep refuse container according to claim 1, wherein the one or more contact parts are depressions around said body part or in one or more sides of said body part.

6. The deep refuse container according to claim 1, wherein said one or more contact parts are formed in said body part.

7. The deep refuse container according to claim 1, wherein said one or more contact parts are separate and fixedly attached to said body part.

8. The deep refuse container according to claim 1, wherein said body part further comprises a lid.

9. The deep refuse container according to claim 8, wherein said lid is hinged.

10. The deep refuse container according to claim 8, wherein said lid comprises a gravitational lock.

11. The deep refuse container according to claim 2, wherein the height of said frame part is about 0.5 m-1 m from a bottom of said frame part to the ground level.

12. The deep refuse container according to claim 2, wherein said one or more contact parts is a protrusion, such as a collar around said body part or a shoulder in one or both sides of said body part.

13. The deep refuse container according to claim 2, wherein said one or more contact parts are depressions around said body part or in one or more sides of said body part.

14. The deep refuse container according to claim 9, wherein said lid comprises a gravitational lock.

15. The deep refuse container according to claim 1, wherein the one or more contact parts provided in the side of the body part are provided at the upper portion of the body part.

* * * * *